United States Patent [19]

Weetman

[11] Patent Number: 4,882,098

[45] Date of Patent: Nov. 21, 1989

[54] MASS TRANSFER MIXING SYSTEM ESPECIALLY FOR GAS DISPERSION IN LIQUIDS OR LIQUID SUSPENSIONS

[75] Inventor: Ronald J. Weetman, Rochester, N.Y.

[73] Assignee: General Signal Corporation, Rochester, N.Y.

[21] Appl. No.: 209,158

[22] Filed: Jun. 20, 1988

[51] Int. Cl.[4] ..... B01F 3/04

[52] U.S. Cl. ..... 261/93; 209/169; 366/102; 366/168

[58] Field of Search ..... 261/93; 366/102, 168; 209/169

[56] References Cited

U.S. PATENT DOCUMENTS

| | | | |
|---|---|---|---|
| 932,221 | 8/1909 | Winship | 366/102 |
| 2,521,396 | 9/1950 | Moul | 261/93 |
| 2,719,032 | 9/1955 | Schnur | 261/21 |
| 2,892,543 | 6/1959 | Daman | 209/169 |
| 2,964,382 | 12/1960 | Hall, Jr. | 261/93 |
| 3,092,678 | 6/1963 | Braun | 261/87 |
| 3,202,281 | 8/1965 | Weston | 261/93 |
| 3,227,701 | 1/1966 | Pennington | 261/89 |
| 3,288,567 | 11/1966 | Graham | 23/288 |
| 3,342,331 | 9/1967 | Maxwell | 261/93 |
| 3,378,141 | 4/1968 | Warman | 261/87 |
| 3,464,552 | 9/1969 | Warman | 261/87 |
| 3,536,305 | 10/1970 | Lefrancois | 209/169 |
| 3,628,775 | 12/1971 | McConnell | 261/121.1 |
| 3,814,396 | 6/1974 | Gregorio et al. | 261/93 |
| 4,066,722 | 1/1978 | Pietruszewski | 261/87 |
| 4,207,275 | 6/1980 | Stanton | 261/93 |
| 4,231,974 | 11/1980 | Engelbrecht | 261/87 |
| 4,247,391 | 1/1981 | Lloyd | 209/164 |
| 4,451,373 | 6/1984 | Thayer | 210/626 |
| 4,454,078 | 6/1984 | Engelbrecht | 261/93 |
| 4,468,130 | 8/1984 | Weetman | 366/330 |
| 4,521,349 | 6/1985 | Weber | 261/93 |
| 4,527,904 | 7/1985 | Weetman | 366/348 |

FOREIGN PATENT DOCUMENTS

| | | | |
|---|---|---|---|
| 918726 | 2/1947 | France | 261/93 |
| 1580389 | 9/1969 | France | 210/220 |
| 6062 | of 1906 | United Kingdom | 261/93 |
| 2106806 | 4/1983 | United Kingdom | 209/170 |

OTHER PUBLICATIONS

See Ch-Breucker, A. Steiff, P.-M. Weinspach (6th European Conference on Mixing) Interactions Between Stirrer, Sparger and Baffles Concerning Different Mixing Problems, Pavia, Italy: 24–26 May, 1988.

*Primary Examiner*—Tim Miles

*Attorney, Agent, or Firm*—Martin Lukacher

[57] ABSTRACT

A mixing system for dispersing gas or other fluids in liquid which may have a solid suspension so as to improve mass transfer to the liquid or its solids suspension while maintaining a low pattern which is substantially axial (up and down) in the tank containing the liquid thereby also facilitating mixing (blending) utilizes an (unshrouded) axial flow impeller which provides the desired single stage axial flow downwardly to the bottom of the tank and upwardly along the sidewalls of the tank with radial flow confined principally to the bottom region of the tank. A sparge system which releases the gas or other fluid in the region at the bottom of the tank where the flow is predominantly radial allows attainment of gas rates with complete dispersion of gas throughout the tank which rates are much higher (about four times as great) as when conventional sparge systems are used with axial flow impellers.

18 Claims, 10 Drawing Sheets

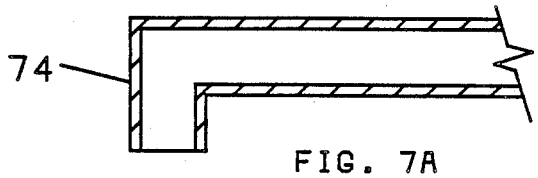
FIG. 7A
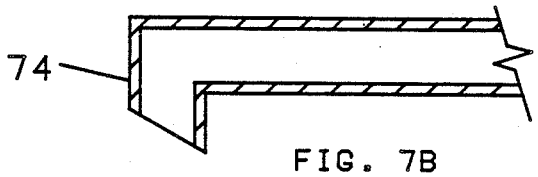
FIG. 7B
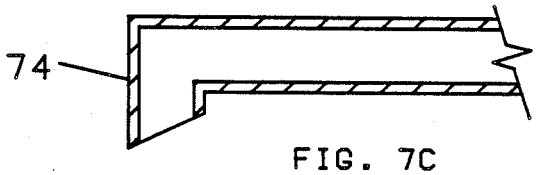
FIG. 7C
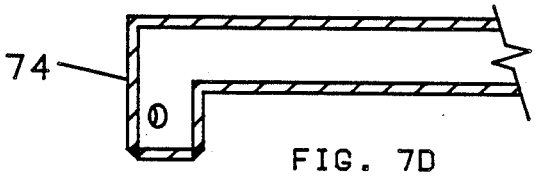
FIG. 7D
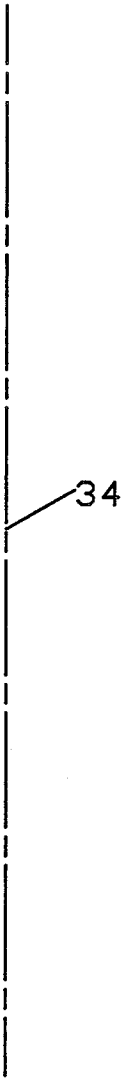

MASS TRANSFER MIXING SYSTEM ESPECIALLY FOR GAS DISPERSION IN LIQUIDS OR LIQUID SUSPENSIONS

DESCRIPTION

The present invention relates to mass conversion mixing systems and particularly to mixing systems which disperse or sparge gas or other fluids into a liquid which may have a solid suspension.

The principal object of this invention is to provide a mixing system using an axial flow impeller which provides flow patterns which are principally axial (up and down) throughout the tank in which the dispersion occurs which can disperse the gas or other fluid at much higher gas rates before flooding occurs than has heretofore been obtainable with axial flow impellers.

Existing gas dispersion technology using axial flow impellers as the primary gas dispersion impellers were not able to handle high gas rates without severe flooding. Flooding is the condition where the mixing system is not in control of the flow pattern in the liquid, rather the gas is in control. The gas then overcomes the pumping action of the mixing impeller and controls the flow pattern in the tank, usually with geysering of the gas through the surface (or level) of the liquid at the top of the tank. The flooding condition limits the ability of the impeller to disperse gas. Mass transfer of the gas into the liquid becomes inefficient or solids suspended therein becomes ineffective at the gas rate where the flooding condition occurs.

The flooding condition in a conventional gas dispersion system is shown in FIG. 1A. There, the liquid 10 in a tank 12 is mixed by an axial flow impeller 14 which is rotated by a shaft 15. The sparge system is illustrated as a pipe 16, and may also be a ring or square pipe with openings at the top thereof. The sparge pipe 16 is disposed below the impeller. Upon flooding some radial dispersion may occur. The gas flow predominates over the downward pumping action of the impeller. Strong geysers occur as shown at 17 and the holdup, U, over the ungassed height, Z, of the liquid in the tank is reduced. The holdup is a measure of how much the mixing system is holding the gas in the liquid and therefore is an indication of the mass transfer conversion potential. The comparison of the system under flooding conditions with condition prior to flooding when the gas rate is reduced and complete dispersion occurs will be apparent from FIG. 1B where like parts and the parameters U and Z are identified by like letters and reference numerals.

Historically, radial flow impellers have been used for gas dispersion when high gas rates are needed. Such impellers are disadvantageous for several reasons. They are less efficient in terms of the power level required to circulate the liquid in the tank (e.g., horsepower per 1000 gallons of liquid into which the gas is dispersed), than axial flow systems. Radial dispersion results in higher fluid shear rates than with axial flow impellers. High shear is undesirable for many processes, such as in some fermentations where shear sensitive microorganisms thrive in environments with low fluid shear rates.

A significant disadvantage of radial flow gas dispersion systems is that the flow pattern is not principally axial but rather is radial and usually has two loops, one of which extends outwardly from the impeller towards the bottom of the tank and the other outwardly from the impeller towards the top of the tank. Such flow patterns are less desirable for solid suspension and blending than the single loop flow pattern characteristic of axial flow impellers. Incomplete dispersion is another drawback of radial flow systems. The classical radial flow system uses a Rushton type radial flow impeller with a sparge pipe or ring below the impeller. A more advanced design is shown in FIG. 1C and utilizes a radial flow impeller system of the type described in Engelbrecht and Weetman, U.S. Pat. No. 4,454,078 issued June 12, 1984. This impeller system 20 with its radial flow impeller 22 and sparge ring 24 are diagrammatically shown in FIG. 1C. The liquid inlet to the impeller, which rotates about its vertical axis 25, is below the impeller 22 in the region shown at 26. The volume of the liquid below the impeller does not have any dispersion of gas and the gas dispersion does not extend to the bottom of the tank. In a typical installation, where the impeller is about one diameter off the bottom, approximately one-fourth of the total volume of the tank does not have a dispersion of gas. If the impeller is moved to higher elevations in the tank, this region without gas dispersion gets larger. The lower limit for the elevation of the impeller in the tank is limited because at the bottom the inlet region 26 becomes too small to support circulation. In a typical installation at less than one-half diameter elevation, the flow cannot make the turn into the region 26 and the power level drops abruptly. The mechanical loads on the mixer system then can increase. The dispersion capability thus breaks down when the radial flow impeller is located too close to the bottom of the tank. The volume of liquid in which the gas is dispersed is therefore smaller with a radial flow impeller than with an axial flow impeller, and for like gas rates, the holdup, U, and the mass conversion rate is less under many conditions in the radial flow than in the axial flow case. However, axial flow impellers have been limited in the gas rate which they can disperse because of the onset of the flooding condition. It has been suggested that radial flow impellers be used for gas dispersion in combination with axial flow impellers; thus an impeller having one or more axial flow impellers below which a radial flow impeller is mounted on the same shaft as the axial flow impellers have been proposed.

An improved mixer system in accordance with this invention makes it possible to use an axial flow impeller as the primary gas dispersion impeller. The system, may use one or more axial flow impellers mounted on the same shaft. Yet, the system has the ability to disperse gas and handle gas rates as high as or higher than radial flow impellers without severe flooding. The invention therefore allows the gas (when the term gas is mentioned, it shall be taken to include other fluids which are to be dispersed or sparged) with adequate dispersion and with the flow pattern for blending, solids suspension and efficiency which for axial flow impellers are more desirable or better for many applications than radial flow impellers. Another application where axial flow patterns are more desirable is heat transfer where the tank has a jacket or other heat exchanger in heat transfer relationship with the fluid in the tank.

Accordingly, it is the principal object of the present invention to provide an improved mixing system for gas dispersion using axial flow impellers.

It is a further object of the present invention to provide an improved mixing system for gas dispersion which uses one or more open axial flow impellers. An open impeller is an impeller without a shroud or tube, such as a draft tube, which confines the flow pattern. The use of baffles along the walls of the tank does not constitute shrouding of the impeller.

Briefly described, a mixing system for dispensing a fluid, such as gas, into a liquid which can have solids suspended therein and which embodies the invention uses a tank having a bottom and sidewalls which extend axially of the tank. The tank contains the liquid which fills it to a level above the bottom of the tank. Impeller means are used which provide an axial flow pattern having principally axial components upwardly and downwardly between the bottom of the tank and the level of the liquid therein and a radial flow component in a direction across the bottom of the tank towards the sidewalls thereof. The outlet flow from the impeller is the axial flow downwardly towards the bottom of the tank and radially towards the sidewalls of the tanks. Means, such as a sparge device are provided for releasing the fluid into the impeller outlet flow outside of where the outlet flow is principally axial and inside where the flow is predominately radial. Then the fluid (gas in most cases) is unable to oppose the axial liquid flow.

The gas or fluid may be a liquid having a density less than the density into which the fluid is to be dispersed.

The sparge device is in the region of the tank which extends between the bottom of the tank and the impeller and is located outside of the diameter of the impeller, preferably at an elevation which is about the same as the elevation of the bottom edges of the blades of the impeller. Preferably the elevation of the outlet of the sparge device is as low as it can practicably be based without blocking the radial flow across the bottom of the tank. An elevation of approximately one-tenth the diameter of the impeller (0.1D approximately) is presently preferred. The advantages of the invention (higher gas rates before flooding than with conventional axial flow gas dispersion systems) can be obtained where the sparge device outlet is at an elevation above the bottom of the tank up to approximately one-half D. The impeller itself may be located at an elevation as measured from its centerline (in a plane perpendicular to the axis of rotation of the impeller through the center of the impeller) of from 0.15D to 2.0D. The size of the tank is not critical. For tall tanks, several impellers may be mounted on the same shaft one above the other. Typically, the tank diameter, T, may be in the range such that the ratio of D to T (D/T) is approximately from 0.1 to 0.6.

The effectiveness of the mixing system provided by the invention is presently believed to be due to a complex of factors, all of which contribute to allowing the axial flow impeller to continue to work as a fluidfoil, even at high gas rates without flooding. Fluidfoil impellers operate by developing a pressure differential in the fluid across the impeller blades. In the presence of gas, because of the low pressure on the suction side of the blades, the blades may stall or separate (the fluid not flowing along the suction surface of the blade) thereby reducing the pressure differential and the pumping effectiveness. As gas is introduced into the tank the gas does collect on the suction side of the blades. These cavities of gas do increase until the entire suction surface of the blade can be filled with a gas cavity. As more gas is introduced the entire blade is enveloped in gas and therefore will not pump axially. Then flooding occurs.

In a system embodying the invention, the outlet flow of the impeller shears the gas bubbles and produces the finer dispersion and the impeller is able to handle many times the amount of gas without flooding. Among other factors that may be responsible for this improved performance is that the energy of the gas is not opposing the energy of the mixer by being underneath it as in a conventional system. The invention is of course not limited to any particular theory or mode of operation of the system as described and claimed herein.

The foregoing and other objects, features and advantages of the invention, as well as presently preferred embodiments thereof, will become more apparent from a reading of the following description in connection with the accompanying drawings. In the drawings, FIGS. 1A, 1B and 1C are diagrammatic views of gas dispersion impeller systems showing the gas dispersion capabilities thereof. These views are discussed above and are labeled "prior art".

FIGS. 2A, 2B and 2C are diagrammatic views of mixing systems in accordance with presently preferred embodiments of the invention; the system shown on FIG. 2A utilizing an axial flow impeller, type A315, which is available from Mixing Equipment Company, 135 Mount Read Boulevard, Rochester, N.Y., U.S. 14603 and which is described in the above identified Weetman patent application Ser. No. 31,037 filed Mar. 26, 1987 and FIG. 2B using an axial flow impeller which is of the Pitch blade turbine type, known as A200, also available from Mixing Equipment Company, and has four blades which are plates at 45° to the axis of rotation of the impeller.

Figure 1A:
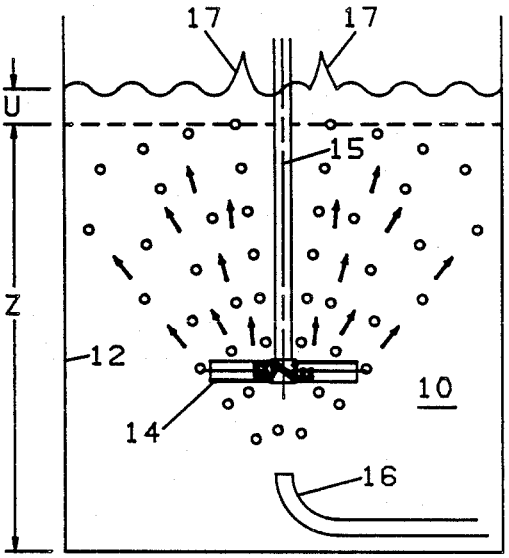
Figure 1B:
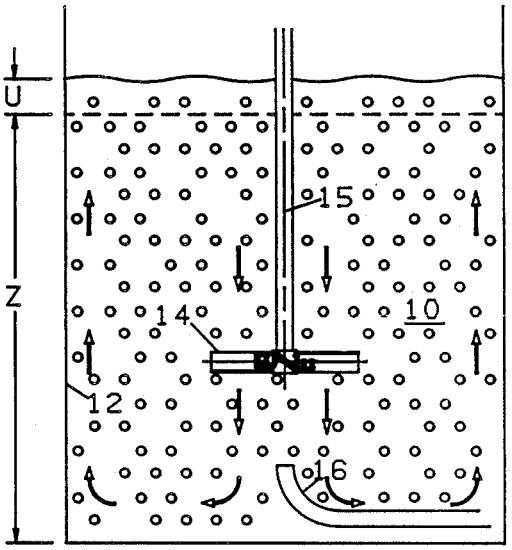
Figure 1C:
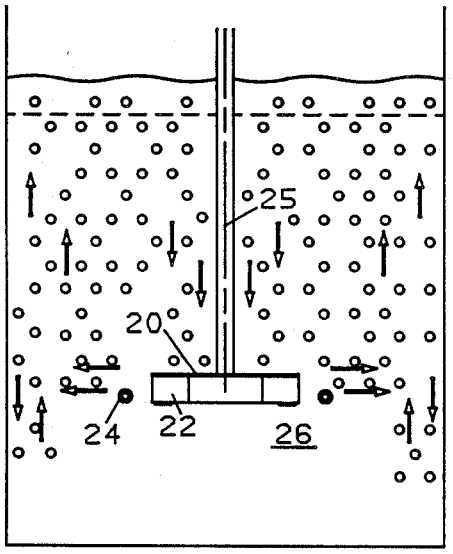
Figure 2A:
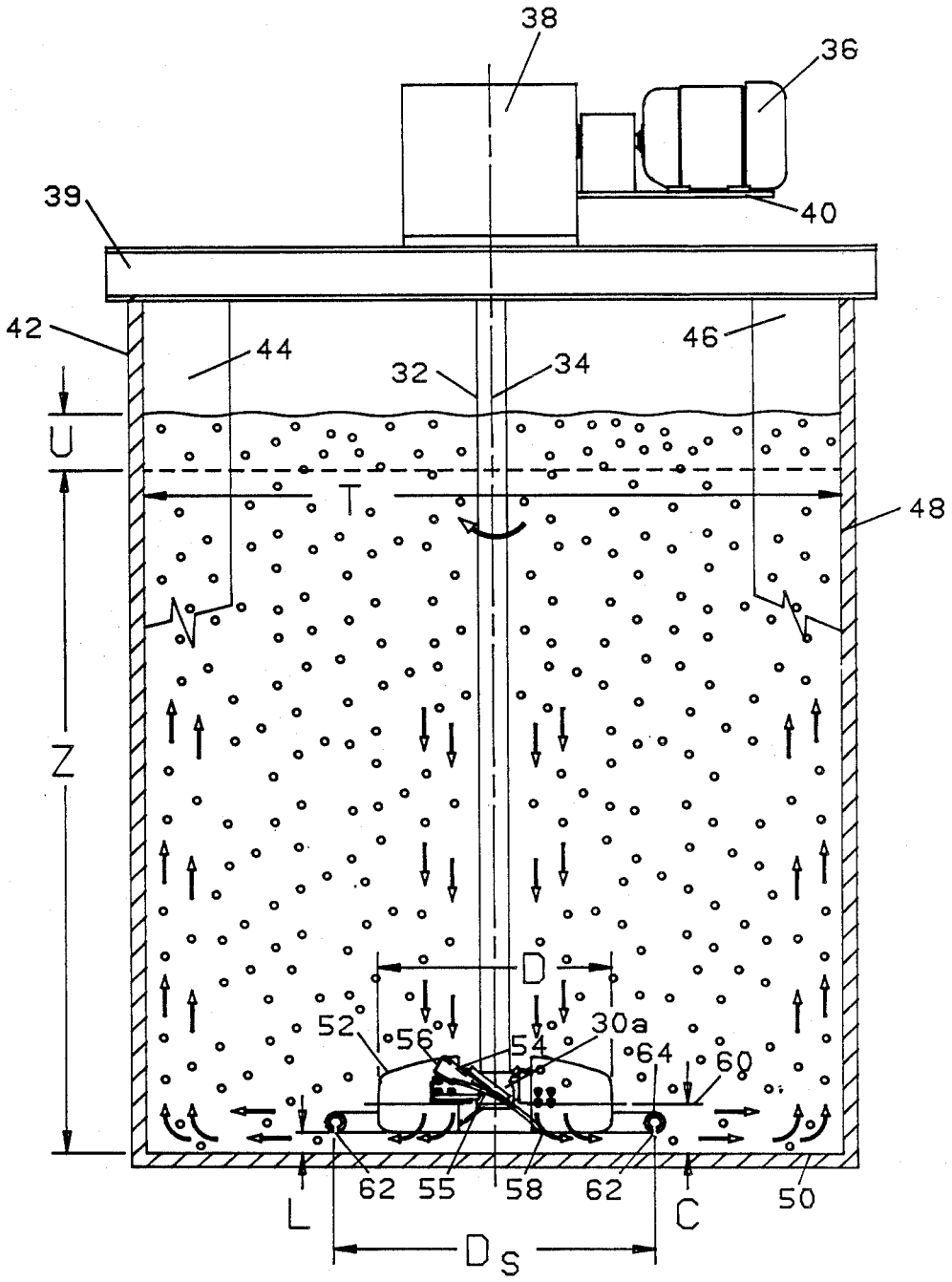
FIG. 2C is an enlarged view of the portion of FIG. 2A showing the impeller and sparge ring.
Figure 4:
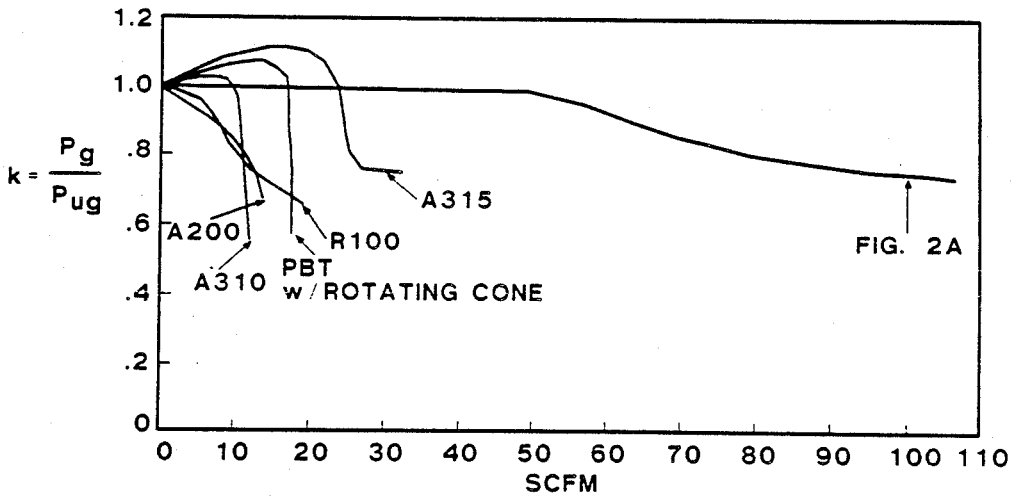

FIG. 4 is a series of curves showing the relationship of K factor (relative power consumption or the ratio of the power consumption $P_g$ to $P_{ug}$ for the gassed and ungassed condition with impeller speed constant for several different types of impeller systems. The curves show where the K factor drops which indicates the occurrence of the flooding condition. The curve for a Rushton type radial flow impeller is labeled R100. The curve for a system using a pitch blade turbine (PBT) with a rotating cone (more information with respect to which is found in U.S. Pat. No. 4,066,722 issued Jan. 3, 1978) is labeled PBT with case. The curve for an axial flow impeller, type A310, available from Mixing Equipment Company, using a sparge ring or pipe as exemplified in FIGS. 1A and 1B (reference Weetman, U.S. Pat. No. 4,468,130 issued Aug. 28, 1984), is labeled A310. The curve labeled A315 is for a conventional system, such as shown in FIGS. 1A and 1B (or with a sparge ring instead of a pipe sparge device utilizing an axial flow impeller of the A315 type as described in the above referenced Weetman U.S. Patent Application. The curve labeled FIG. 2A shows the K factor and the absence of any flooding condition well beyond the gas rate of any of the other systems identified in FIG. 4.

FIG. 5 shows various embodiments of sparge rings which may be used in mixing systems in accordance with the invention.

Figure 6B:
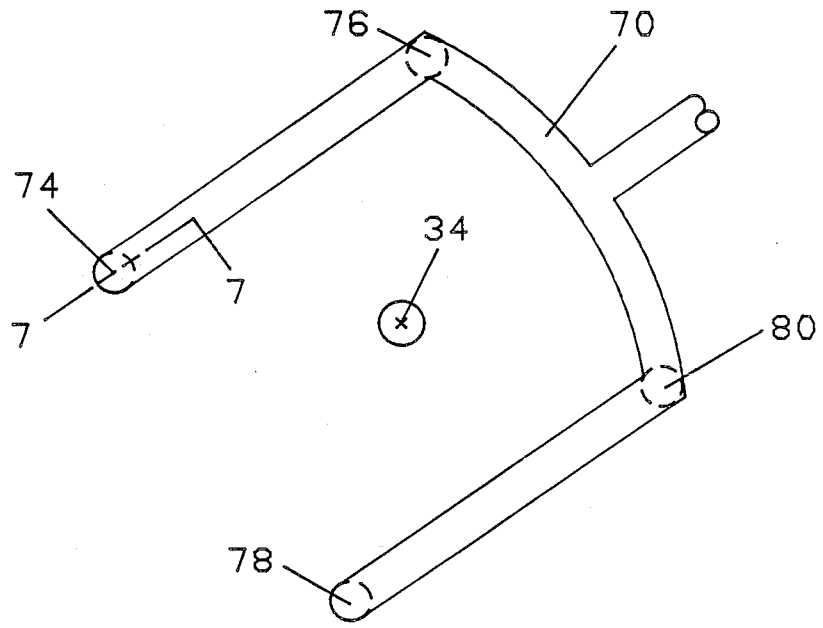
Figure 6A:
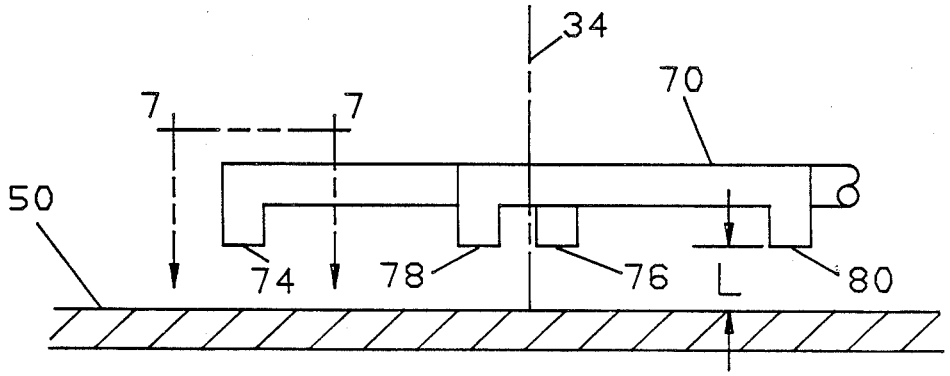

FIGS. 6A and 6B are an elevation and a top view of another sparge device which may be used in accordance with the invention.

FIG. 7 shows cross sectional views of different types of outlet ports which may be used in the sparge device shown in FIGS. 6A and 6B; the sections shown in FIG. 7 being taken along the line 7—7 in FIG. 6B.

Figure 2B:
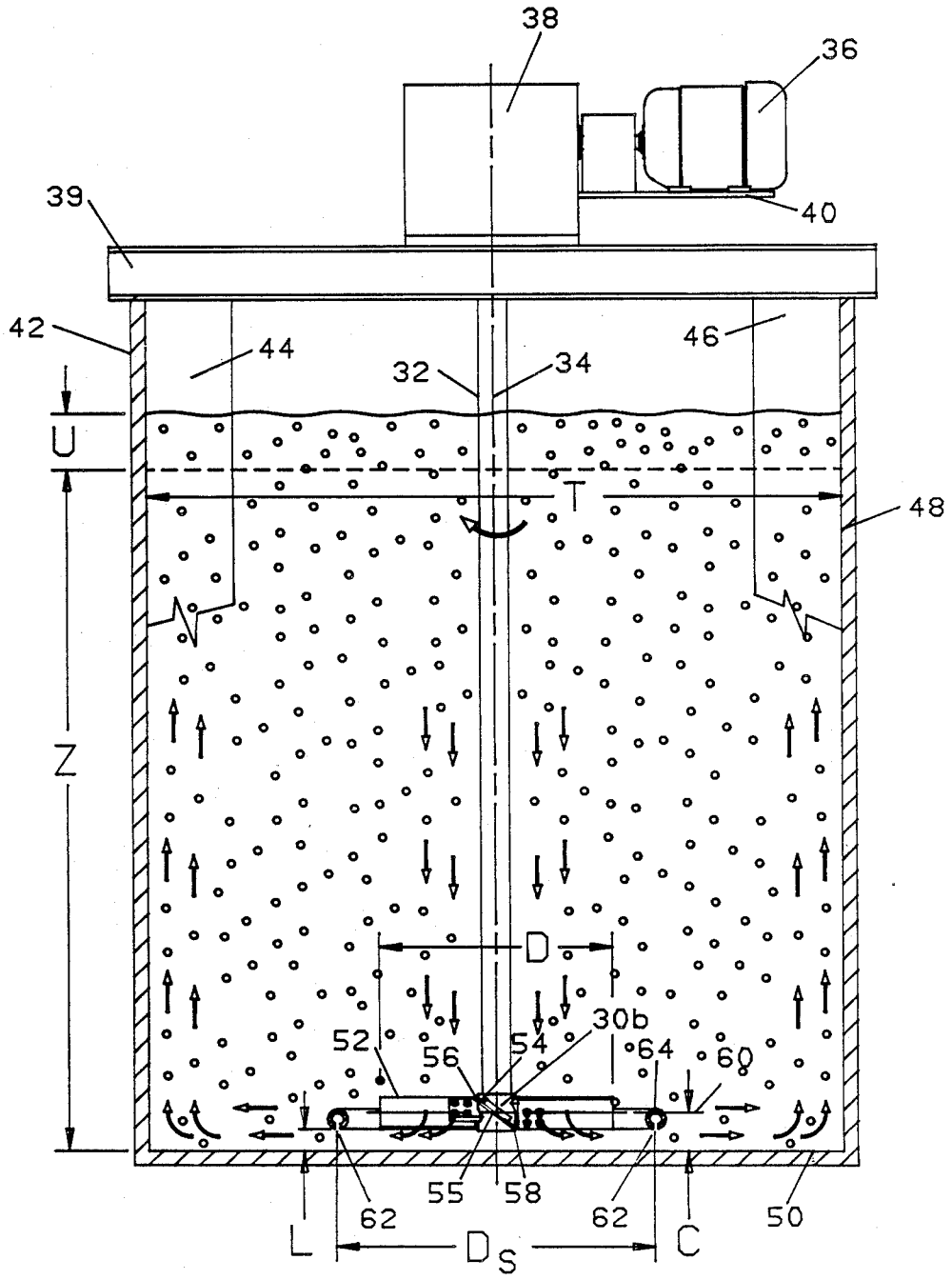
Figure 2C:
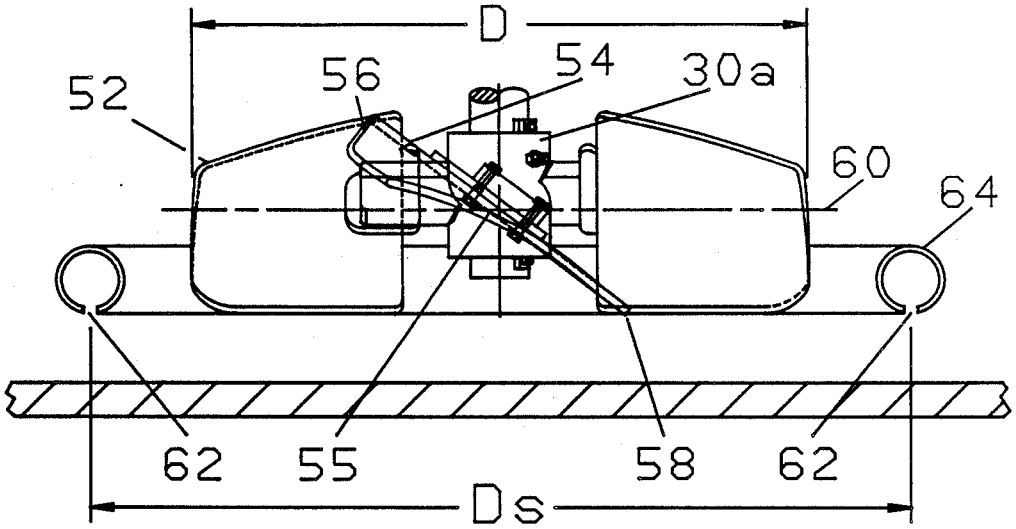

Referring to FIGS. 2A and 2B, there are shown diagrammatically mixing systems embodying the invention which are similar except for the impeller 30a and FIG. 2A and 30b in FIG. 2B. In FIG. 2A the impeller is of the A315 type having four blades in pairs diametrically opposite to each other. The blades are generally rectangular and have camber and twist which increases towards the shaft 32. The impeller 30b is a pitched blade turbine with four blades in diametrically opposed pairs. Each blade is a plate which is oriented at 45° to the axis of rotation of the impeller which is the axis 34 of the shaft 32. The illustrated pitched blade turbine 30b (PBT) is of the A200 type. The impeller is driven by a drive system consisting of a motor 36 and gearbox 38 which is mounted on a support, diagrammatically illustrated as beams 39 and 40, which are disposed over a tank 42 containing liquid with solid suspension. The ungassed height Z and the holdup U are illustrated for the case where gas is completely dispersed.

There are baffles, two of which are indicated at 44 and 46 which extend radially inward from the sidewalls 48 of the tank 42. The bottom 50 of the tank may be flat. The bottom may be dished or contoured. When using a dished bottom, the elevations are measured along perpendiculars to the bottom to the point where the perpendiculars intersect the bottom. The baffles may be spaced 90° from each other circumferentially about the axis 34.

The impellers 30a and 30b are designed to be downpumping with their pressure surfaces being the lower surfaces 55 of their blades 52 and the suction surfaces being the upper surfaces 54 of the blades. The blades have upper and lower edges indicated at 56 and 58. The diameter of the impeller between the tips of the blades (the swept diameter) is indicated as D. The impeller has a centerline 60 which is in a plane perpendicular to the axis 34 through the center of the impeller (halfway between the upper and lower edges 56 and 58). The elevation of the impeller above the bottom of the tank is measured between the centerline 60 and the bottom 50 of the tank and is indicated as C.

The outlets for the gas are provided by circumferentially spaced apertures or openings 62 in a sparge ring 64. The distance between the sparge openings 62 and the bottom 50 of the tank is indicated as L. Where the bottom 50 is dished or contoured, L is the clearance. The distance between diametrically opposite openings 62 is the sparge diameter $D_s$. $D_s$ is greater than D. Preferably, $D_s$ is from about 1.3D to 1.4D. The preferred embodiment of the invention as shown in FIGS. 2A and 2B provides both the blades and the sparge device 64 at an elevation from the bottom of the tank so that the outlets 62 are in line with (in the same horizontal plane as) the lower edges 58 of the impeller 30.

It has been found that the principal advantage of the invention (higher gas rates before flooding) occur when the elevation L of the sparge opening 62 is about 0.5D or less. The preferred elevation is approximately 0.1D. In the illustrated embodiments in FIG. 2A, L is approximately 0.094D and for FIG. 2B, L is 0.092D. In FIG. 2A, C is approximately 0.26D and in FIG. 2B, C is approximately 0.17D. The A315 impeller diameter D of FIG. 2A is about 16.3 inches while the A200 of FIG. 2B is 16.0 inches in diameter. L is 1½ inches elevated from the bottom 50 of the tank 42. The sparge ring outlets are preferably 1.3 to 1.4 times the diameter of the impeller ($D_s$=1.3D to 1.4D). In the embodiments shown in FIGS. 2A and 2B. $D_s$=1.35D. The openings 62 are at 180° where 0° is the top of the ring and parallel to the axis 32. In other words, the openings face downwardly.

The elevation of the impeller, C, may be in the range 0.15D to 2D (C=0.15D to 2D). The elevation L of the sparge opening 62 may remain at approximately 0.1D but may extend upwardly to approximately 0.5D. The flooding condition onset occurs at greater gas rates when the openings 62 are in line with the lower edge 58 of the impeller blades and the elevation expressed as the ratio C/D is in the lower end of the range. These characteristics will become more apparent from FIGS. 3A and 3B. The diameter of the tank and whether the tank is rectilinear in cross section or round is not critical. Good results can be expected when the tank diameter T, expressed as the ratio D/T, is in the range from about 0.1 to 0.6.

The flow pattern is indicated by the arrows and has a single loop which, of course, is a torus with axial components extending upwardly and downwardly from the level of the liquid at the top of the tank to the bottom of the tank with a radial flow pattern at the bottom of the tank. The outlet flow from the impeller is the axial and the radial component at the bottom of the tank in FIGS. 2A and B. The outlet flow is principally the radial component at the bottom of the tank. The sparge outlets 62 are disposed in the radial flow and specifically inside the radial outlet flow and outside the axial outlet flow. The radial flow shears the gas into fine bubbles which then are uniformly dispersed throughout the volume of the liquid in the tank. The axial flow pattern maintains solids in suspension. There is minimum shear where the solids are in suspension. The high efficiency of axial flow mixing systems is maintained. For example, the power number $N_P$, which is equal to $P/(\text{rho})N^3D^5$, is about five times lower than the power number for radial flow impellers. In the definition of power number $N_P$, P is the power delivered to the impeller in watts, (rho) is the density of the liquid (in kilograms per cubic meter), N is the impeller speed in revolutions per second and D is the impeller diameter in meters (the diameter swept by the tips of the impeller blades).

Figure 3A:
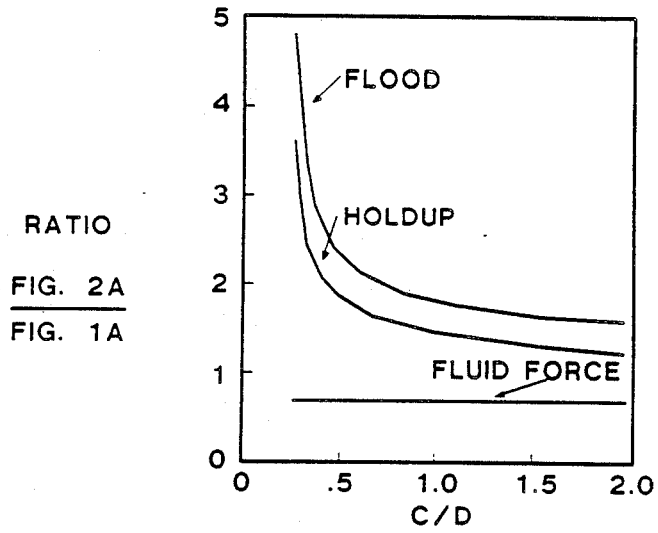
FIGS. 3A and 3B are curves comparing three parameters, namely flood (the flooding condition point), holdup (U) and fluid force obtained with the system shown in FIGS. 2A and 2B, respectively, with a conventional axial flow gas dispersion system of the type shown in FIGS. 1A and 1B.
Figure 3B:
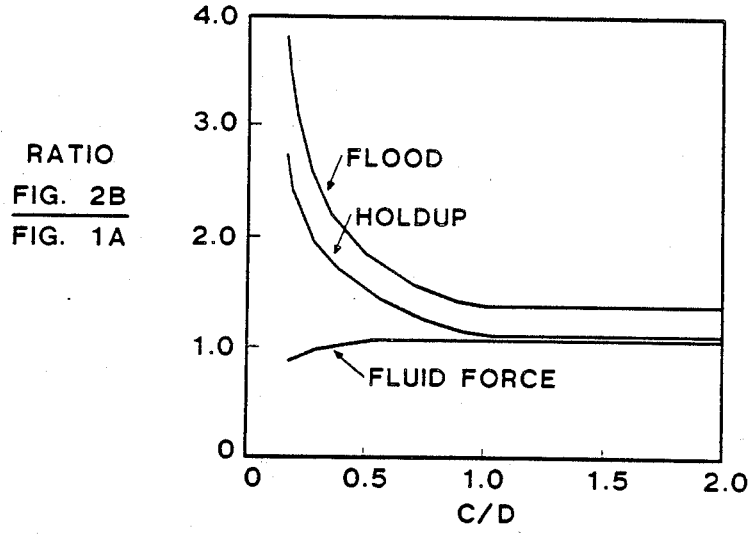

The new and surprising results obtained from the mixing system which is provided in accordance with the invention and specifically, the systems illustrated in FIGS. 2A and 2B, are illustrated in FIGS. 3A and 3B, respectively. In both cases, the configuration of the system is with the sparge ring 64 as shown in FIGS. 2A and 2B at an elevation of approximately 0.09D above the bottom 50 of the tank 42. The elevation of the impeller in terms of the ratio C/D is varied and is shown on the X axis of the curve. The data in these curves was taken with the sparge ring 21.7 inches in diameter as measured at $D_s$. The comparison is with a conventional system using an axial flow impeller of the same type and diameter (a 16.3 inch diameter A315 and a 16 inch A200) with a sparge pipe having its outlet below the impeller as shown in FIGS. 1A and 1B.

Three parameters are plotted for various C/D ratios over a range up to C/D=2 which shows that advantages are obtained over the range 0.15 to 2.0 for the ratio C/D. Three curves are plotted, showing the onset of the flooding condition. One of the curves is labeled "flood". The second curve is labeled "holdup" and represents the parameter U. The greater the holdup the more gas is dispersed and the larger the mass conversion potential (gas into liquid). The third curve is labeled "fluid force". Fluid forces are the unsteady reacting forces acting on the impeller and shaft which tend to bend the shaft. When these forces are diminished, the mechanical integrity of the mixing system is maintained and is less likely to be adversely affected during operation. Reference may be had to Weetman U.S. Pat. No. 4,527,904 for further information respecting fluid forces and methods of their measurement. It will be observed from FIG. 3A that the fluid forces are always less than that obtained in the conventional system over the entire C/D range. The flooding point occurs at gas rates from 1.6 to 4.8 times greater than for the conventional system. The holdup is also greater. For the A200 system (PBT) as shown in FIG. 3B, the fluid forces are not substantially affected over the range. However, the holdup and flooding condition points are improved to almost four times in the case of flooding and almost 2.8 times in the case of holdup.

Another way of looking at the point when the flooding condition occurs is by examination of the K factor. The striking superiority of the system provided in accordance with the invention is illustrated in FIG. 4. In this figure, both the conventional Rushton and other types of conventional axial flow impeller systems are compared with the system shown in FIG. 2A. The flooding condition for the FIG. 2A system occurs at approximately 100 SCFM.

FIG. 5 illustrates various embodiments of the sparge ring 64. The ring shown in FIGS. 2A and 2B is illustrated in FIG. 5A. The orientation of this ring may vary as shown in FIGS. 5E and 5F from 0° in FIG. 5F to 270° (inwardly towards the axis of rotation 34) in FIG. 5E. FIG. 5B shows a rectangular cross section for the ring which is one form of rectilinear cross section.

Figure 5A:
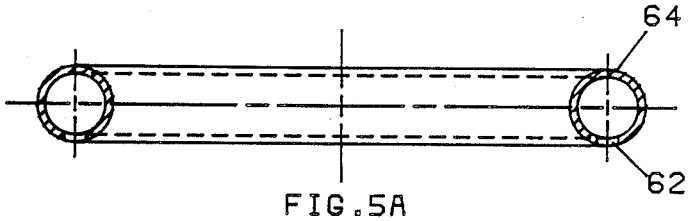
Figure 5B:
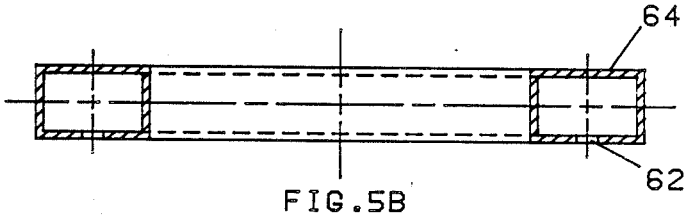
Figure 5C:
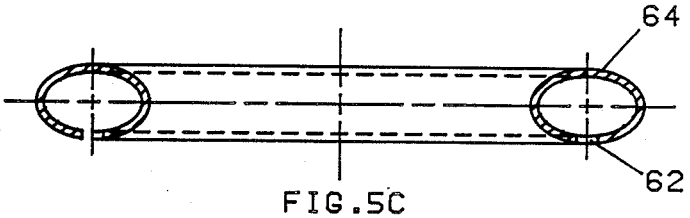
Figure 5D:
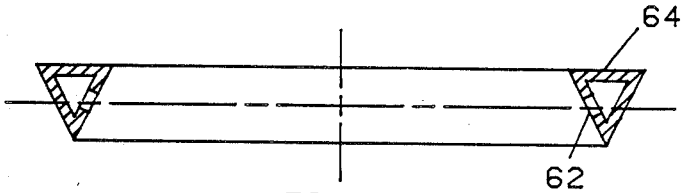
Figure 5E:
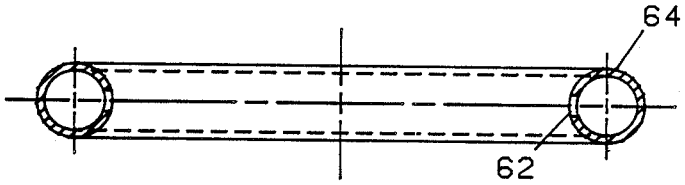
Figure 5F:
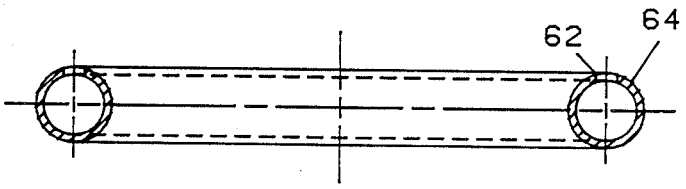

FIG. 5C shows an elliptical cross section and FIG. 5D shows a triangular cross section with the opening 62 in the inside leg of the triangle.

Referring to FIGS. 6A, 6B and FIG. 7, there is shown a sparge device in the form of a fork shaped pipe 70 with four ports or outlets in the form of pipe segments 74, 76, 78 and 80. The outlets are at the elevation L from the bottom 50 of the tank (FIG. 6A). The orientation is shown with respect to the axis of rotation 34. It is seen in FIG. 7 that the segments may be open at the bottom and either flat (perpendicular to the axis 34) or angled or curved either inwardly or outwardly away from the axis. The segments may have a closed end cap with an outside hole as shown at 75 in FIG. 7D.

From the foregoing description, it will be apparent that there has been provided improved mixing systems especially adapted for gas dispersion. These systems have surprising advantages over conventional axial flow gas dispersion or sparging systems which utilize axial flow impellers. While various embodiments of the systems and parts thereof have been illustrated, variations and modifications thereof within the scope of the invention will undoubtedly suggest themselves to those skilled in the art. Accordingly, the foregoing description should be taken as illustrative and not in a limiting sense.

I claim:

1. A mixing system for dispersing a fluid into a liquid which can have solids suspended therein which comprises a tank having a bottom and side walls which extend axially of said tank, said tank containing the liquid to a level above the bottom of said tank, a drive to turn an impeller, impeller means for providing a recirculating, axial flow pattern having principally axial flow components upwardly and downwardly between the bottom of the tank and the level of the liquid therein and a radial flow component in the direction across the bottom of said tank toward the side walls thereof, the outlet flow from said impeller means being a predominately axial flow downwardly towards the bottom of said tank and a predominately radial flow towards the side walls of said tank, means for releasing said fluid in said outlet flow outside where said flow is axial and in said radial flow which is inside where said flow is radial, whereby said fluid is unable to oppose said axial outward flow, said releasing means being in a region of said tank which extends between the bottom of said tank and a plane through said impeller means which plane is perpendicular to the axial direction.

2. The system according to claim 1 wherein said fluid has a density less than the density of said liquid.

3. The system according to claim 2 wherein said less dense fluid is gas.

4. The system according to claim 1 wherein said impeller means is at least one open, axial flow impeller having a diameter D, said releasing means having at least one outlet, said outlet being disposed outside the diameter of said impeller, and said outlet being disposed in a region of said tank at or below an elevation above the bottom of said tank which is about in alignment with the bottom of said impeller.

5. The system according to claim 4 wherein said impeller has a plurality of blades rotatable about an axis, said blades having tips the distance between which and said axis defining the radius R of said impeller, where $2R=D$, said outlet being disposed at an elevation not exceeding about 0.5D above the bottom of the tank.

6. The system according to claim 5 wherein said impeller is disposed at an elevation C measured to a plane extending perpendicular to said axis and centrally therethrough where C is from about 0.15D to 2.0D.

7. The system according to claim 6 wherein the elevation, L, of said outlet is about 0.1D above the bottom of said tank and said outlet is disposed at about 1.3 to 1.4R from said axis.

8. The system according to claim 7 wherein said outlet is in alignment with the lower edges of said blade.

9. The system according to claim 4 wherein said releasing means is a pipe and said outlet is one of a plurality of outlet ports which are spaced from each other around said axis.

10. The system according to claim 9 wherein said ports are pipe segments which extend downwardly from said pipe towards the bottom of the tank, said ports being selected from the group consisting of downwardly facing openings at the end of said segments perpendicular to said axis, openings in the sides of said segments opposing said axis, and downwardly facing openings inclined to said axis.

11. The system according to claim 9 wherein said pipe is a ring with its center approximately along said axis, said ring having a radius greater than R and said outlet ports being openings in said ring spaced from each other around said ring.

12. The system according to claim 11 wherein said openings in said ring face the bottom of said tank.

13. The system according to claim 11 wherein said openings in said ring face in the direction towards said axis.

14. The system according to claim 11 wherein said openings in said ring are oriented in an upward direction along said axis.

15. The system according to claim 11 wherein said ring has a cross section selected from the group consisting of circular, elliptical, rectilinear and triangular.

16. The system according to claim 5 wherein the elevation C of said impeller is such that C is from about 0.15D to about 0.30D.

17. The system according to claim 16 wherein said impeller is a pitched blade turbine.

18. The system according to claim 16 wherein said impeller blades are airfoil type.

* * * * *